US006905152B1

(12) United States Patent
Hudson

(10) Patent No.: US 6,905,152 B1
(45) Date of Patent: Jun. 14, 2005

(54) SLIDE BOLT LOCKING SYSTEMS

(76) Inventor: John H. Hudson, 1189 Toschlog Rd., Richmond, IN (US) 47374

( * ) Notice: Subject to any disclaimer, the term of this patent is extended or adjusted under 35 U.S.C. 154(b) by 0 days.

(21) Appl. No.: 10/419,353

(22) Filed: Apr. 21, 2003

(51) Int. Cl.[7] ..... E05C 1/06

(52) U.S. Cl. ..... 292/143; 292/DIG. 15; 292/DIG. 21; 49/365

(58) Field of Search ..... 292/143, 173, 292/185, 188, DIG. 15, DIG. 21; 49/365, 49/366

(56) References Cited

U.S. PATENT DOCUMENTS

| | | | | | |
|---|---|---|---|---|---|
| 449,916 | A | * | 4/1891 | Raisor | 292/60 |
| 921,765 | A | * | 5/1909 | Whitaker | 292/153 |
| 1,057,995 | A | * | 4/1913 | Bull | 292/193 |
| 1,162,945 | A | * | 12/1915 | Ohnstrand | 292/138 |
| 1,225,285 | A | * | 5/1917 | Swaim | 292/175 |
| 1,670,430 | A | * | 5/1928 | Alexander | 292/143 |
| 1,765,775 | A | * | 6/1930 | Schenck | 292/173 |
| 1,864,177 | A | * | 6/1932 | Batina | 292/173 |
| 2,086,474 | A | * | 7/1937 | Gietl | 292/143 |
| 2,815,975 | A | * | 12/1957 | Check | 292/143 |
| 2,819,107 | A | * | 1/1958 | Muessel | 292/143 |
| 3,556,573 | A | * | 1/1971 | Miller | 292/143 |
| 4,315,647 | A | * | 2/1982 | Wilzig et al. | 292/143 |

OTHER PUBLICATIONS

GB 2 263 303 A Fong Seet Min, published—Jul. 21, 1993.*

* cited by examiner

*Primary Examiner*—Gary Estremsky
(74) *Attorney, Agent, or Firm*—Woodard, Emhardt, Moriarty, McNett & Henry LLP

(57) ABSTRACT

A slide bolt type of closure locking system is disclosed in various configurations in various orientations. A lever arm is used to operate the bolt slide. A detent arrangement normally keeps the lever arm in a nested rest position. The arm can be released from the detent to pivot the arm outward to operate the bolt slide. A pivot blocker is operable to prevent folding of the arm from its outward posture when needed to operate the bolt slide. Various lock case configurations are adapted to embedded or socket-mounting, or channel mounting, or surface mounting installations in swinging, sliding or folding closures.

9 Claims, 15 Drawing Sheets

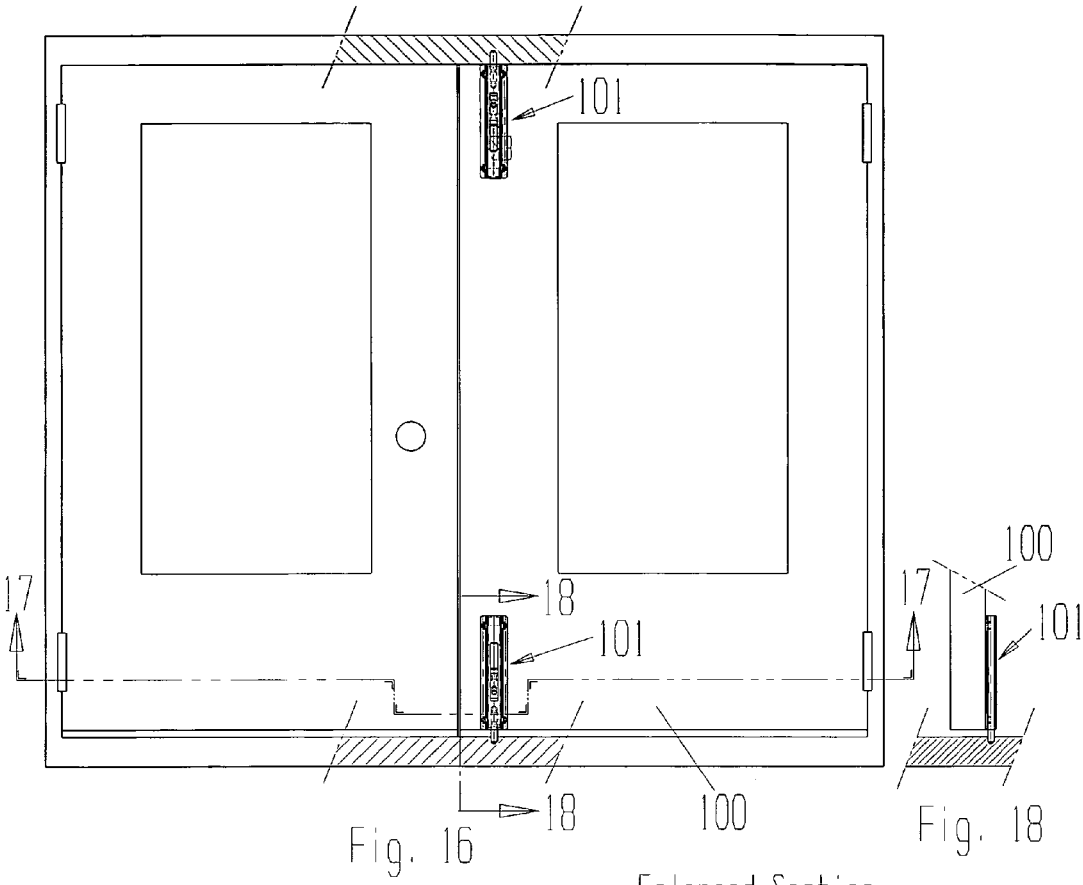
Fig. 16
Fig. 18
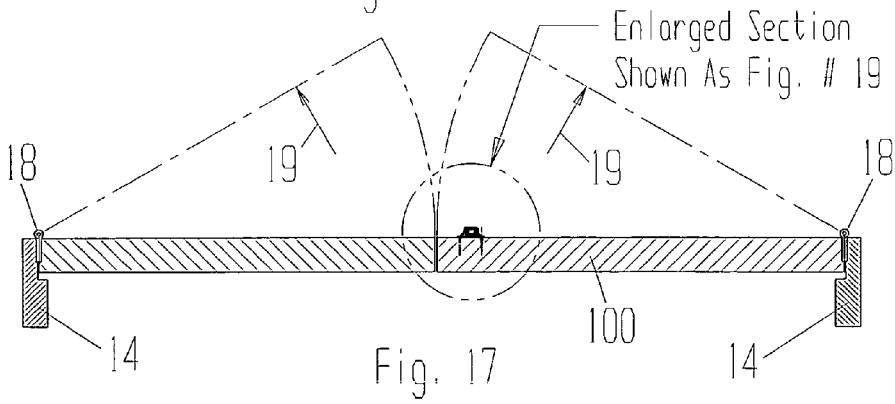
Fig. 17

SLIDE BOLT LOCKING SYSTEMS

BACKGROUND OF THE INVENTION

1. Field of the Invention

The present invention relates generally to locks, and more particularly to the type of lock including one part mounted on a door or a window and another part mounted in a member in the frame of a door or window opening, with a bolt in one member slidable into the other member to lock the door or window closed.

2. Description of Prior Art

Typical installations of French doors in a building include two swinging doors hinged at the door jambs to swing inwardly toward the interior of the building. Usually one door is kept closed and may be referred to as a "passive" door, while the other door is used most frequently and can be referred to as the "active" door. To keep the passive door closed, sliding bolt locks are used at the top and bottom of the swinging edge of the door. The bolt in the lock at the bottom of the door is receivable in a socket in the threshold of the doorway, and the bolt of the lock at the upper edge of the door is received in a socket in the header of the doorway. Several problems are often associated with such lock assemblies. Examples are difficulty in installation in a door, limited adaptability to different types of doors and door installations, applicability to only certain types of door and door installation, difficulty in operation, susceptibility to dirt, and susceptibility to tampering. The present invention is directed to addressing these and other lock characteristics.

BRIEF DESCRIPTION OF THE DRAWINGS

FIG. 16 is a view like FIG. 1 but showing a surface mounting embodiment of the invention.

FIG. 17 is a section taken at line 17—17 in FIG. 16 and viewed in the direction of the arrows.

FIG. 18 is a fragmentary view taken at line 18—18 in FIG. 17 and viewed in the direction of the arrows.

DESCRIPTION OF THE ILLUSTRATED EMBODIMENTS

Figure 1:
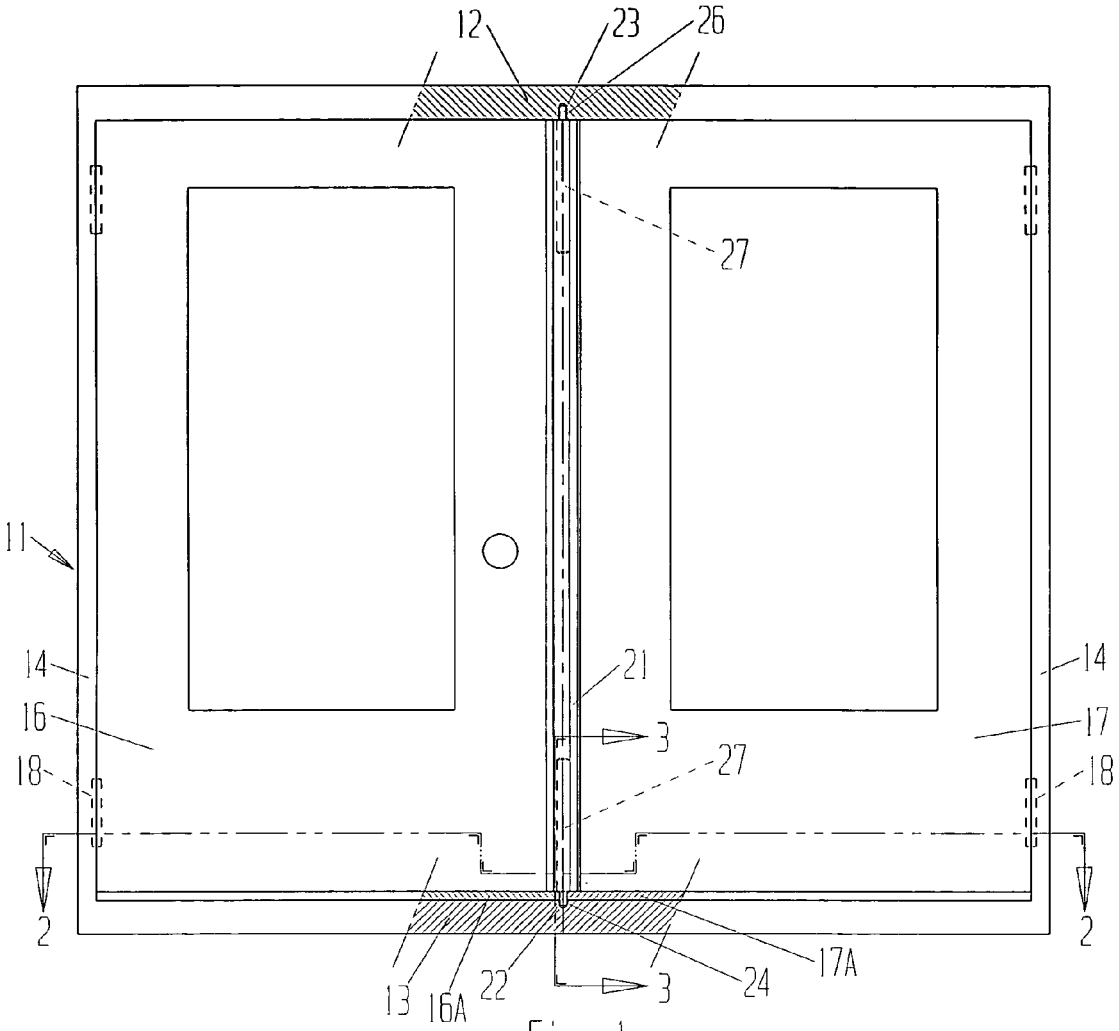
FIG. 1 is a front elevational view of a doorway with double swinging doors and a door-mounted astragal in the center and incorporating slide bolt lock assemblies according to one embodiment of my invention.
Figure 2:
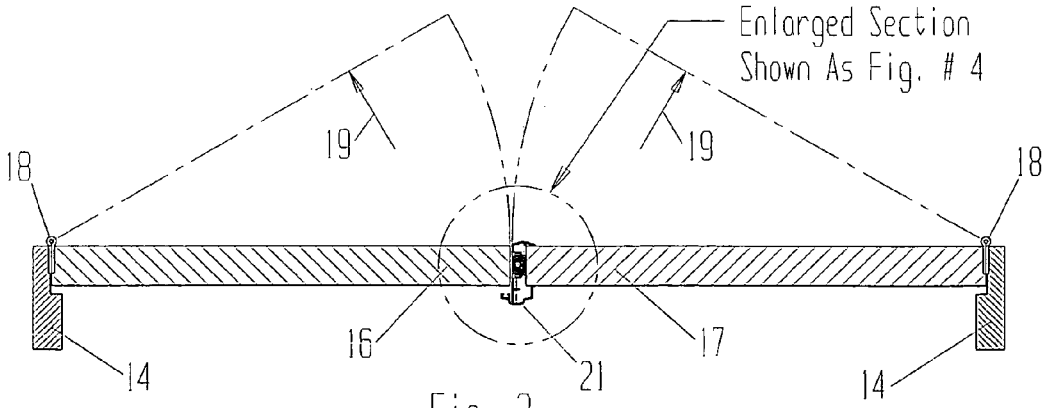
FIG. 2 is a fragmentary sectional view taken at line 2—2 in FIG. 1 and viewed in the direction of the arrows.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to the drawings in detail, a doorway 11 having header 12, sill 13 and jambs 14 receives two doors 16 and 17 hinged at the jambs with hinges 18 such that they swing inward in the direction of arrows 19. As will be seen, the invention is applicable to out-swinging doors as well as in-swinging doors. In the present example, with the in-swinging doors, the active door is 16 having the usual bottom seal strip 16A and the passive door is 17 with a bottom seal strip 17A and an astragal 21 fixed to the edge of the passive door. Slide bolts 22 and 23 are slidably mounted in cases near the bottom and top, respectively, of the astragal 21. They are received in sockets 24 and 26 in the threshold 13 and header 12, respectively. These bolts are slidable out of the receiver sockets to enable opening the passive door 17.

In the FIG. 1-13 embodiment of this invention, bolt 22 and bolt 23 are parts of two identical lock assemblies, one of them mounted at the bottom of the door 17 and the other at the top. Since they are identical, a description of one will suffice for both, and particular reference will be made to the lower lock assembly 27. It includes a generally rectangular elongate case 31 which is received in a groove 32 in the astragal 21. While astragals can be made of various materials and mounted in a variety of ways, in the illustrated example of FIGS. 1–4, it is an aluminum extrusion providing the swinging edge of a metal faced door. The case in which the bolt slides is made of two shells of engineering grade, injection molded plastic. A face or front shell 33 and back shell 34 are ultrasonically welded at plane 37 after the internal components have been assembled inside. Each shell of the case has integral pads on its sides which serve alignment functions during assembly and welding, and alignment and fitting functions when the assembly is driven in the direction of the arrow 41 (FIGS. 3 and 9) into the groove 32 in the astragal 21.

Figure 7:
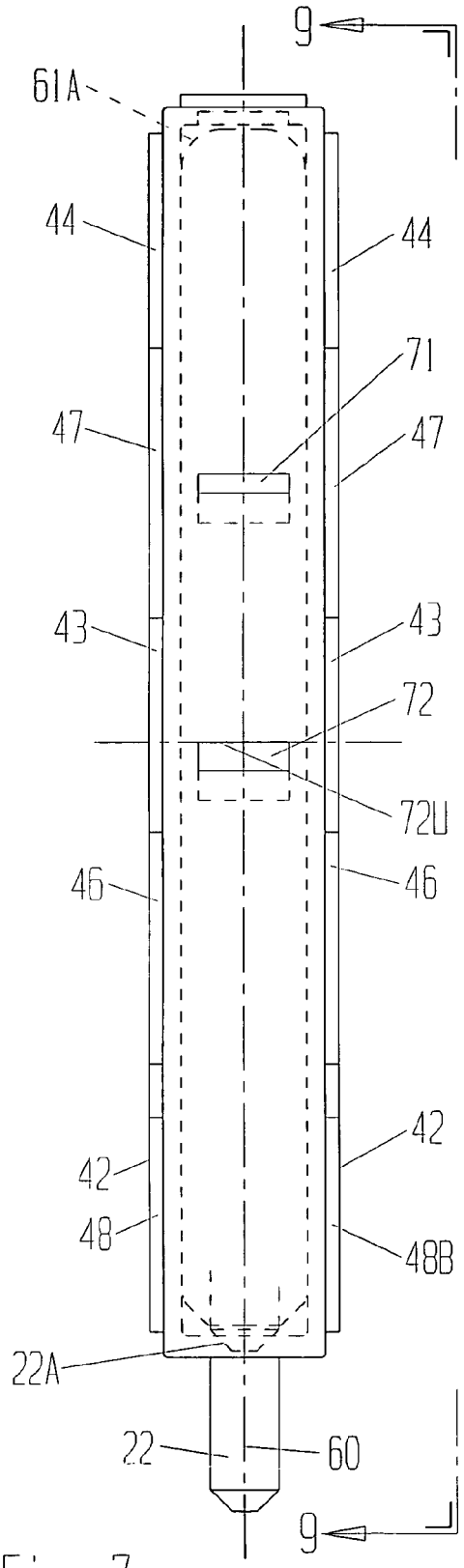
FIG. 7 is a view of the back of the lock assembly taken at line 7—7 in FIG. 6 and viewed in the direction of the arrows.
Figure 9:
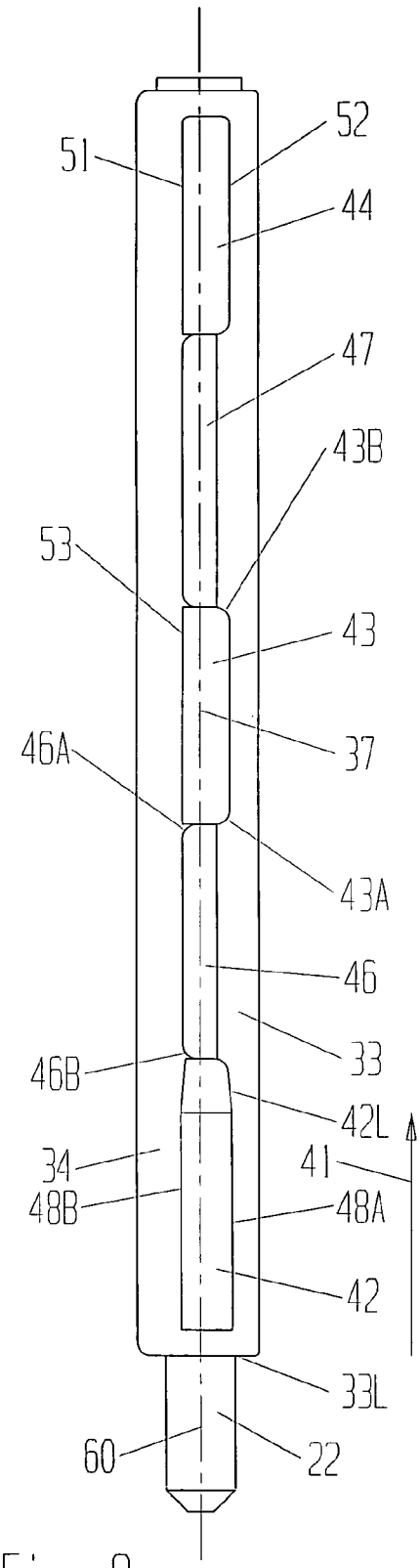
FIG. 9 is a side view of the lock assembly taken at line 9—9 in FIG. 7 and viewed in the direction of the arrows.
Figure 8:
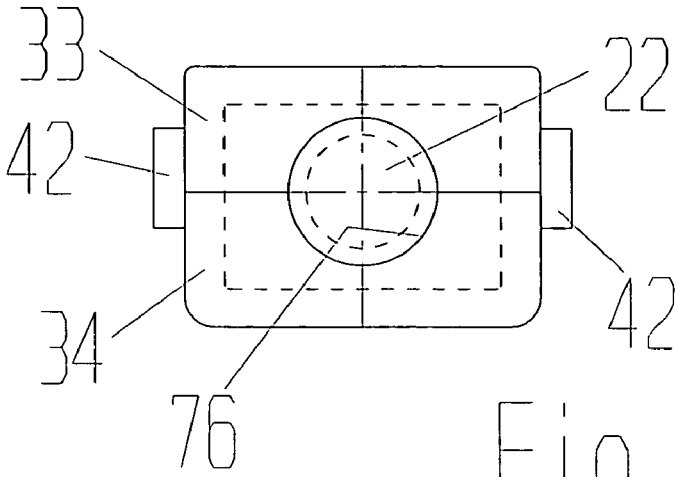
FIG. 8 is a bottom end view of the lock assembly taken at line 8—8 in FIG. 5 and viewed in the direction of the arrows.

Referring in particular to FIG. 9, pads 42, 43 and 44 on both sides of the back shell 34 are integral with shell 34. Pads 46 and 47 on both sides of shell 33 are integral with shell 33. As best shown in FIGS. 7 and 9, these pads are sized and shaped to perfectly interfit upon assembly. Also, the ends of the edges which approach each other during assembly are curved. For example, the ends 46A and 46B of pad 46 are curved. Similarly, the ends 43A and 43B of the pads 43 on the back shell 34 are curved. Therefore, as these pads approach each other during assembly of the two shells, they line-up so that the two shells with their internal components are properly aligned when the shells are ultrasonically welded at line 37.

As mentioned above, the pads provide not only alignment of the two shells during the welding of the assembly, but they also provide guiding surfaces for the lock assembly into channel 32 as the lock assembly is driven into the astragal. The backward facing edges such as 48B of pad 42, 53 of pad 43, and 51 of pad 44, are aligned. While the assembly is driven into the channel 32 of the astragal, these edges can pilot on the edges 49 of the pad receiving grooves 50 (FIG. 4) in the sides of cavity 32 in the astragal. The distance between edges 51 and 52 of pad 44, and between edges 53 and 54 of pad 43 are the same, and are just slightly less than the distance between edges 49 and 56 of the grooves 50 in the sides of the astragal channel 32. So they provide a slip fit in the channel. Therefore, the lock case can be driven with a sliding fit into the groove 32 until the slightly inclined leading edge 42L of the pads 42 enter the groove 50. The distance between edge 48B and edge 48A of the pads 42 is slightly greater than that between edges 51 and 52 of pad 44 and greater than the distance between edges 49 and 56 of the side grooves 50 in the astragal. This creates a light press fit and requires the driving of the case the rest of the way into the astragal if the lower end 33L of the case is to be aligned with the lower end 21L of the astragal to assure clearance of the assembly with the threshold when the door 17 is to be opened. The slide lock assembly in the top of the astragal and containing bolt 23, is mounted in the upper end of the astragal in the same way except, of course, it is driven down into the channel 32 of the astragal. For convenience, the lock bolt assemblies may be installed in the astragal before or after mounting the astragal to the door, and usually before mounting the door into the door opening.

Figure 3:
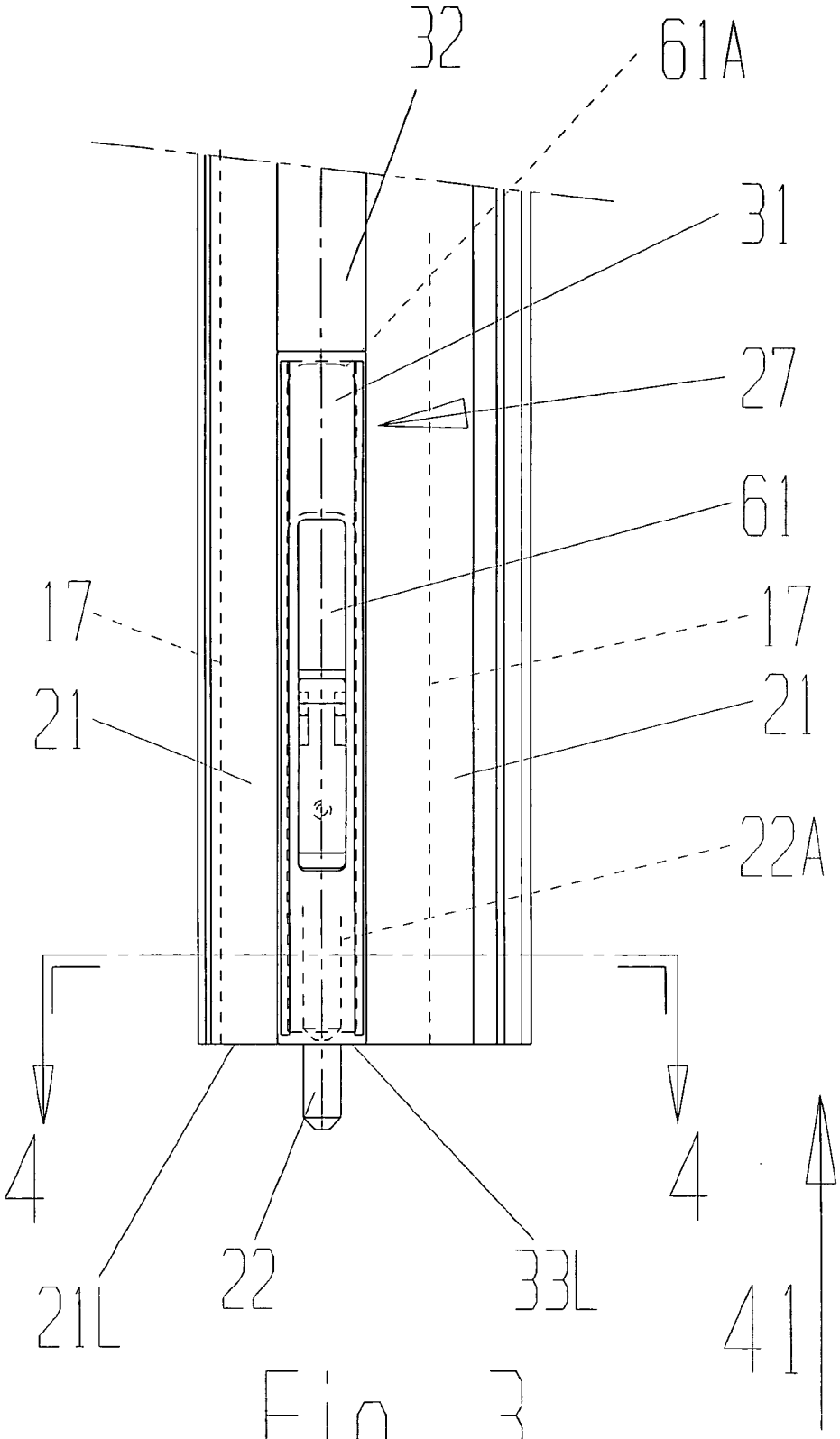
FIG. 3 is an enlarged fragmentary sectional view taken at line 3—3 in FIG. 1 and viewed in the direction of the arrows.
Figure 4:
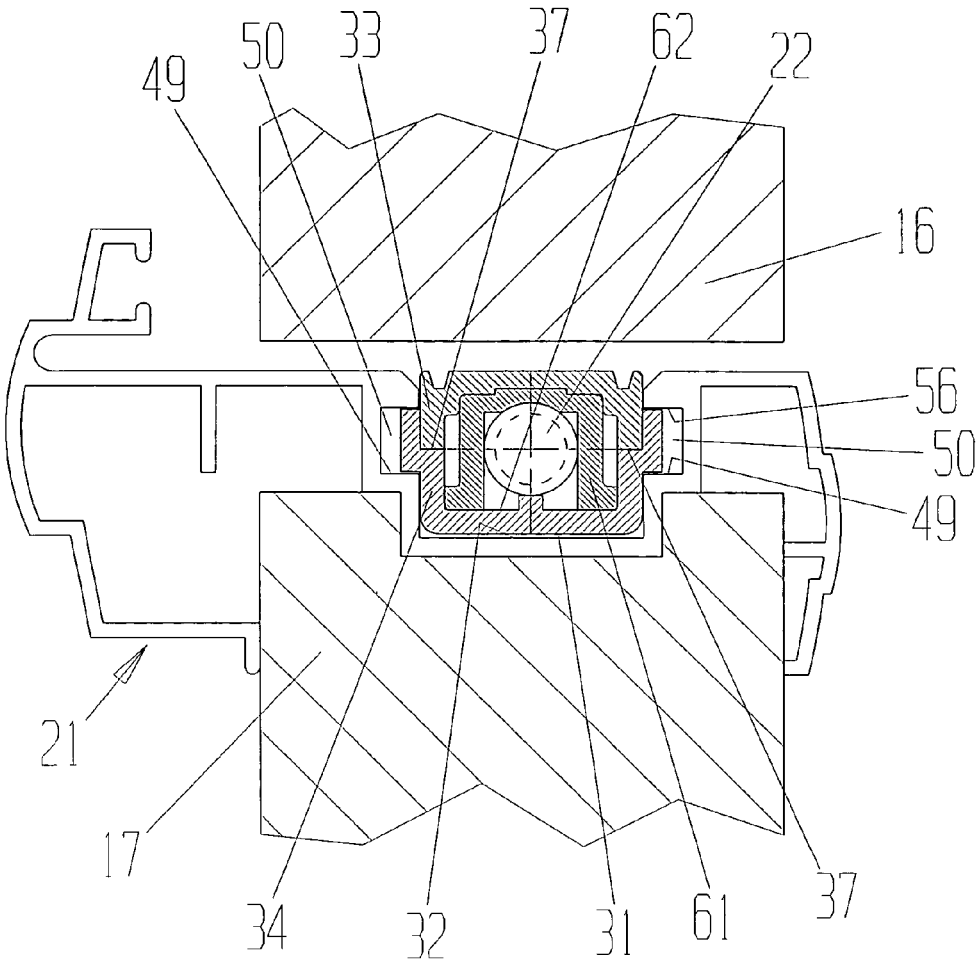
FIG. 4 is a sectional view taken at line 4—4 in FIG. 3, further enlarged and viewed in the direction of the arrows.
Figure 5:
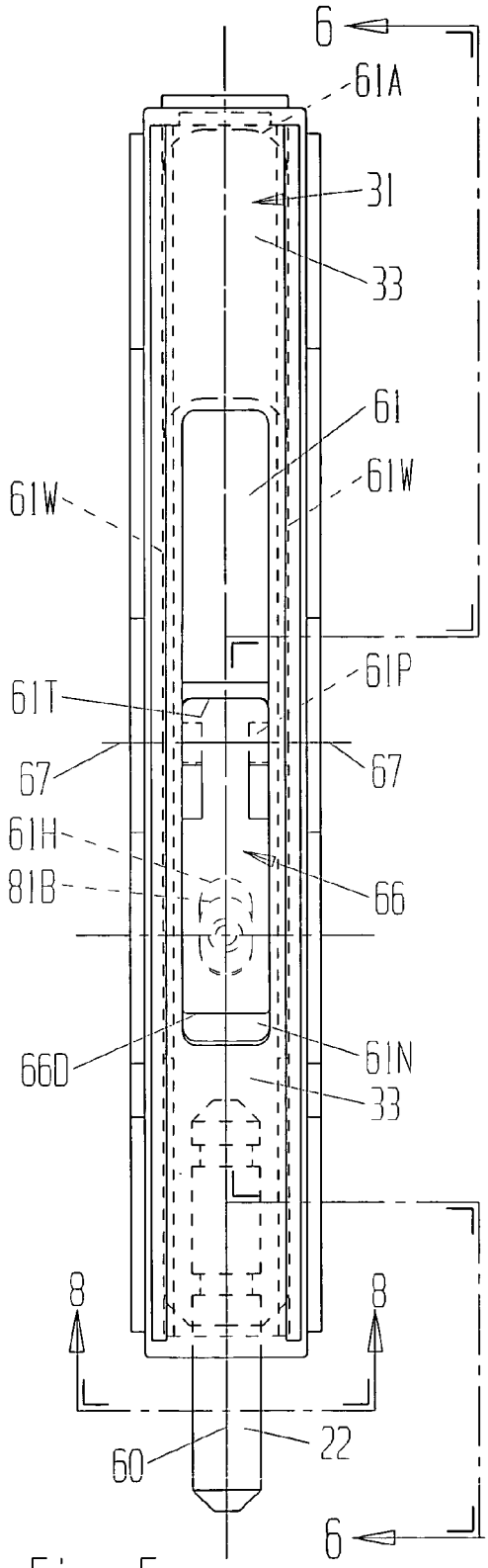
FIG. 5 is an elevational view of the slide bolt lock assembly as in FIG. 3 but larger than in FIG. 3 and omitting the astragal.

Now, referring to the various internal features of the lock assembly according to the illustrated embodiments of the present invention, and which make it particularly useful not only in the site of an astragal in a door assembly, but also in other sites, will be described. FIG. 3 shows the bolt 22 mounted to a slide 61 which is slidably received in the case 31 and operable between an extended position shown in the solid lines in FIGS. 3, 5, 6 and 10, and a retracted position shown by the dashed lines 61A in FIGS. 3 and 5. As shown in FIG. 4, when the portions 33 and 34 of the case are assembled together, they provide a slideway 62 receiving slide 61 and in which the slide is guided as it carries the bolt 22 between the retracted position shown by the dashed line 22A in FIG. 3 and the extended position shown by solid lines in FIGS. 1, 3, 5 and 6.

Figure 11:
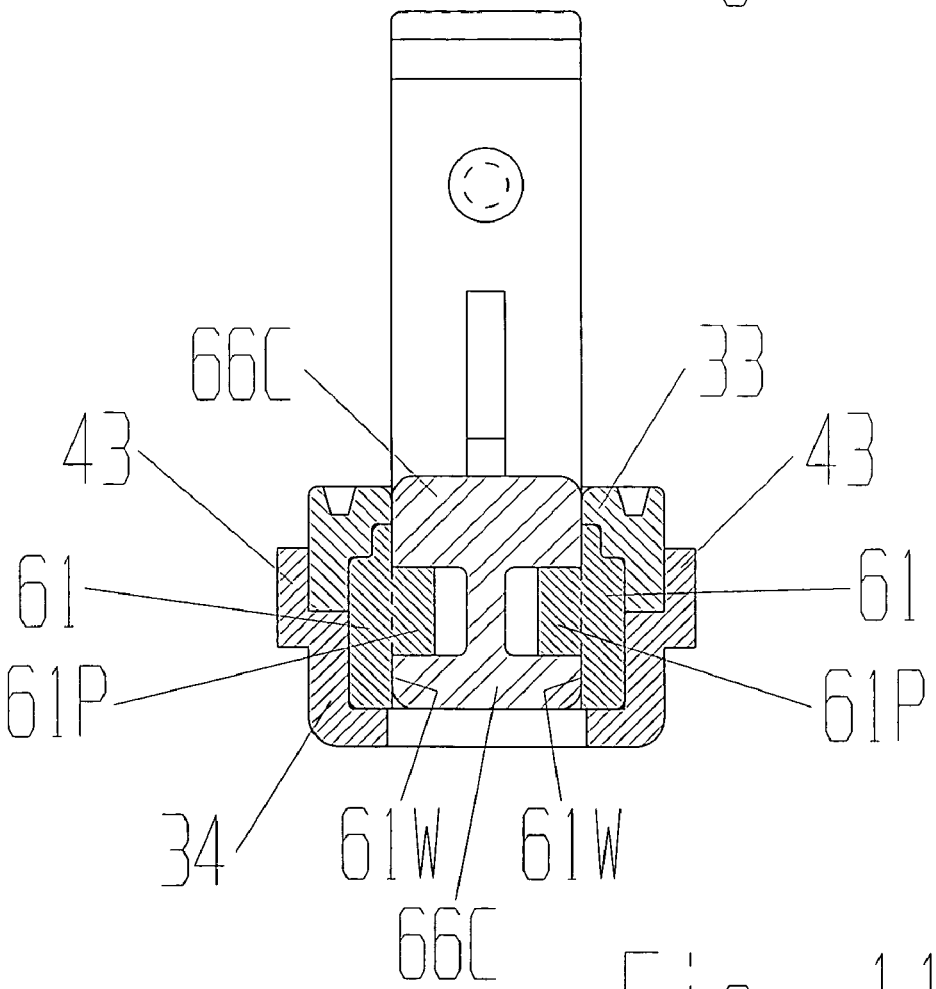
FIG. 11 is a sectional view through the assembly taken at line 11—11 in FIG. 10 and viewed in the direction of the arrows.
Figure 10:
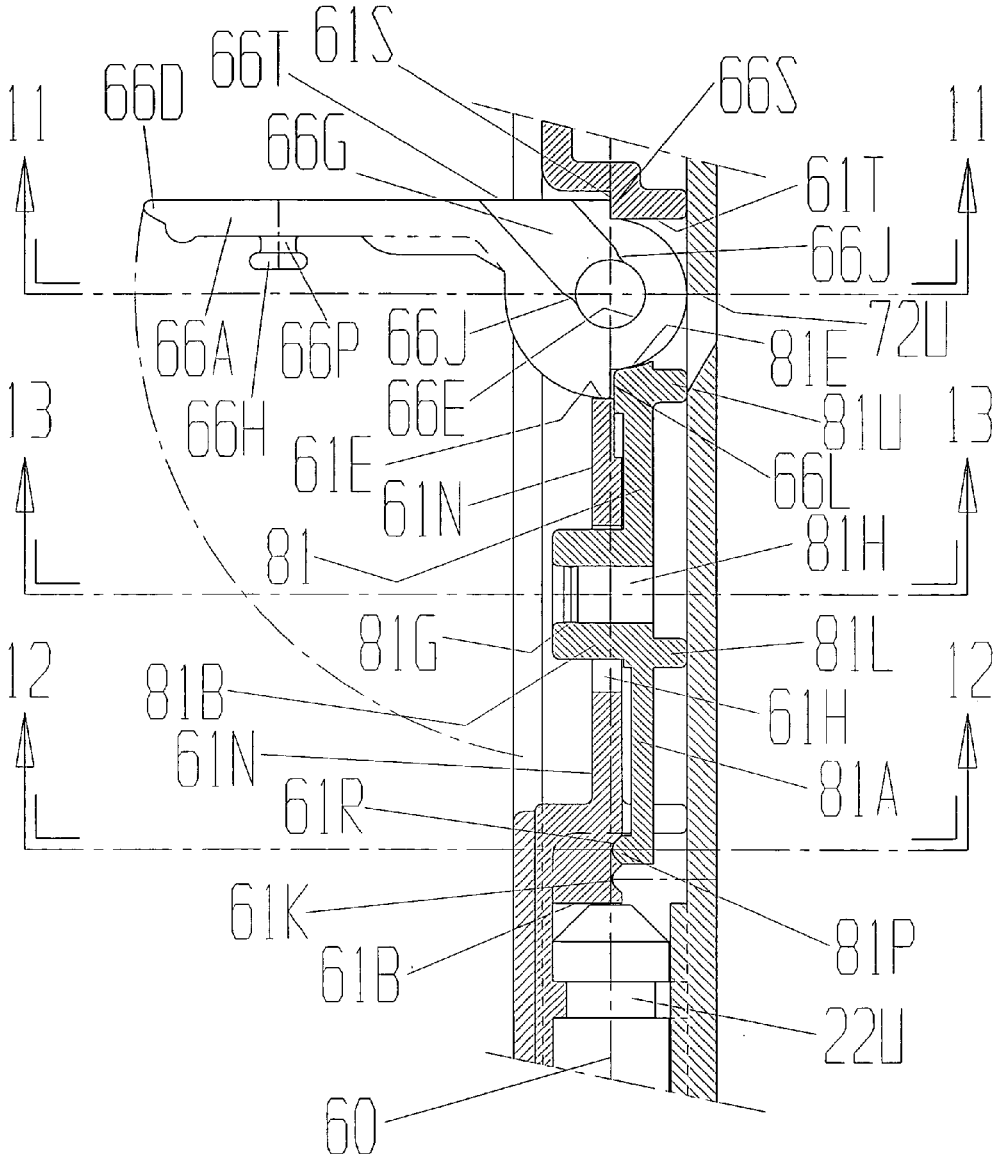
FIG. 10 is a view of a portion of FIG. 6 but enlarged and showing the bolt slide operating lever (not sectioned) in the open position for sliding the slide up or down in the case.
Figure 12:
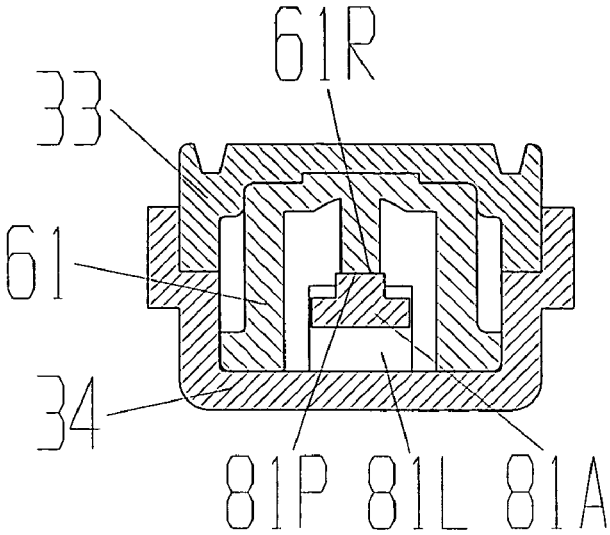
FIG. 12 is a sectional view through the assembly taken at line 12—12 in FIG. 10 and viewed in the direction of the arrows and showing a sectional view of the lever lock slide retainer detent arrangement.
Figure 13:
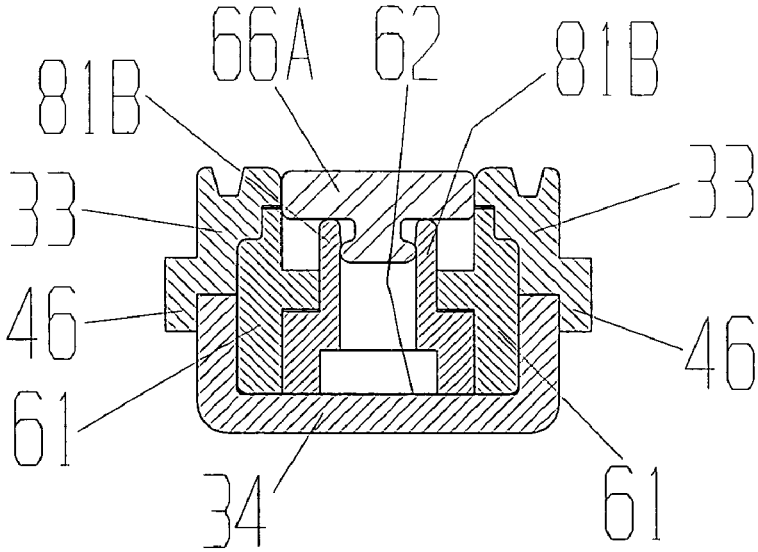
FIG. 13 is a sectional view through the assembly taken at line 13—13 in FIG. 10 and viewed in the direction of the arrows and showing the lever post receiver boss in the lever lock slide.

To operate the slide between the closed stop position and the extension limit position, there is a lever 66. As is true of all of the parts of the lock assembly, except for the steel bolt 22, the lever is made of injection molded engineering grade plastic. The lever has an arm 66A and base 66B molded in one piece. In FIG. 10 the lever itself is shown in a full side view and has a groove 66G in each side and which opens at the top 66T of the lever. Each groove extends down from the top to the semi-circular end portion 66E which is received on a post 61P projecting inward from wall 61W of the slide (FIG. 11). The width of the groove is slightly larger than the diameter of the posts. This enables sliding the lever into place during assembly of the lock. But the transition from the groove to the circular end of the groove is constricted as at 66J to a width less than the diameter of the posts. Therefore, during assembly of the lever to the slide (which is done from the back of the slide before the slide is installed in the case), as the lever is inserted into the slide and pushed into correct position with the groove ends 66E receiving the posts, it will snap into place properly with an audible report and remain there with the lever captured on the posts. The base of the lever is also captured between the inside faces of wall 61W of the slide and lower face of transverse wall 61T of the slide and the upper edge 61E of a transverse partition 61N of the slide. As so confined, the lever is pivotable about an axis 67 which is the axis of the posts 61P in the opposite sidewalls 61W of the slide. The lever is pivotable between the closed position or condition shown in FIGS. 3–9, to the open position shown in FIGS. 10 and 11.

Figure 6:
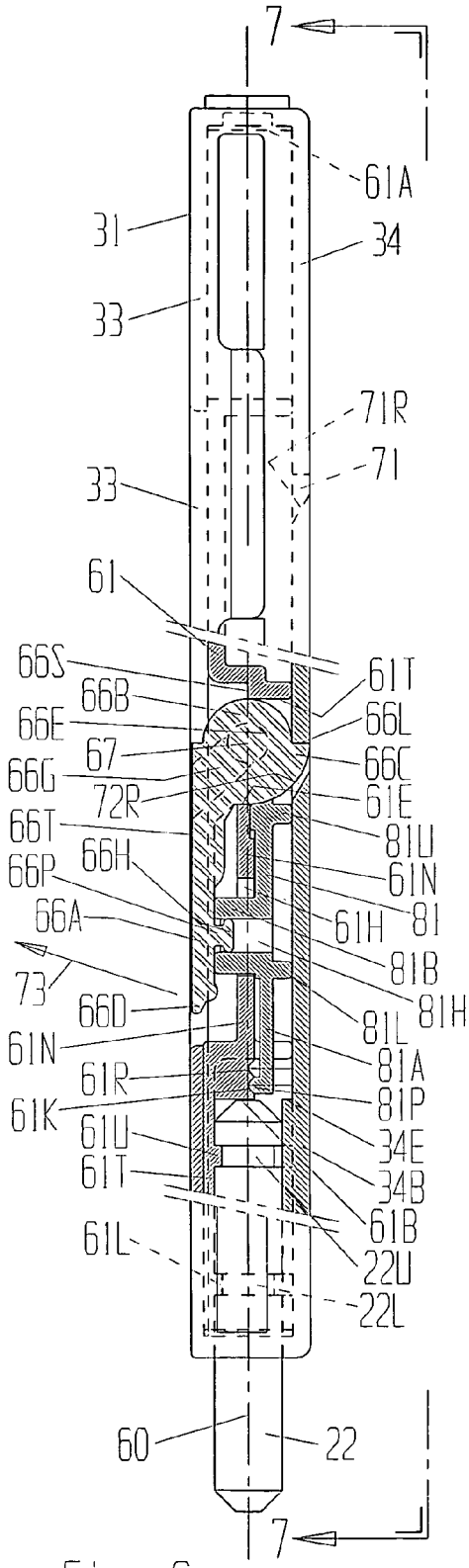
FIG. 6 is a sectional view through the assembly taken at line 6—6 in FIG. 5 and viewed in the direction of the arrows.

To prevent the bolt from sliding in or out except when desired, the lever and case portion have a slide locking feature. As shown in FIGS. 6 and 7, the back half 34 of the case has two slots, upper slot 71 and lower slot 72. As best shown in FIG. 6, each of these slots has a cam ramp such as 71R for slot 71 and 72R for slot 72. As best shown in FIG. 6, cam portion 66C of lever base 66 projects into the lower slot 72. When in this position, a slide lock abutment 66L on the lever base abuttingly engages the upper edge 72U of slot 72 and prevents movement of the slide in the upward direction. Therefore, it will keep the bolt 22 in the socket 24 in the threshold of door 17.

When it is desired to pull the bolt upward and out of the socket 24 in the threshold, the distal end 66D of the lever arm 66A is pulled outward in the direction of the arrow 73 (FIG. 6) whereupon it pivots about axis 67 relative to the slide to an open position such as shown in FIGS. 10 and 11. In that position, an arm stop 61S (FIGS. 6 and 10) on the slide is abutted by a lever stop wall 66S on the lever. As the lever arm is pivoted outward, the cam portion 66C and the stop ledge 66L on it, are pivoted out of the detent slot 72 of the case. Then the lever can be used to pull the slide 61 upward and the bolt 22 therewith, removing it from the socket 24 in the threshold.

As might be expected, the bolt may be made of metal or plastic or any other sufficiently strong material and secured to the slide in various ways. In the form disclosed herein, the lower end portion of the bolt is received in and guided by the hole 76 in the lower end of the case. The back wall 34B (FIG. 6) of the case shell 34 has a forwardly projecting rib extending from the hole 76 upward to an upper end 34E. This rib provides support and guidance for that portion of the bolt behind the center line 60. The portion of the bolt in front of the center line is confined by ribs 61U and 61L projecting inwardly from the sidewalls and top wall of the slide into the circumferential grooves 22U and 22L of the bolt. The upper end of the bolt engages an abutment 61B of the slide.

It was mentioned above that, when the bolt is extended, retraction of it is prevented by the cam portion 66C of the lever base being received in the slot 72 of the case. Opening of the lever to lift the slide makes retraction of the bolt possible. But prevention of inadvertent extension of the bolt while a door is open, is important. For that purpose, the lever is folded back down to the closed position whereupon cam portion 66C of the lever base is received in slot 71 of the case back and prevents the slide from moving downward.

When it is time to close and lock the door, the distal end 66D of the lever arm is pulled outward in the direction of arrow 73. When the lever arm is out as shown in FIG. 10, it unlocks the slide. But sometimes the slide might not just slide downward by gravity force, particularly if the user has not fully closed the door and the bolt is not correctly aligned with the socket, or if there is some slight amount of dirt or contamination in the socket, making it difficult for the bolt to slide downward. So pushing downward on the lever arm might only just close it again without pushing the slide downward.

To enable use of the lever to push the slide down, another feature is incorporated according to my invention. This is a lever lock feature. It includes a lever lock slide 81 (FIGS. 6, 10) received in the case and having a base formed in a downwardly-opening box frame form, the top and bottom transverse walls of the frame being shown at 81U and 81L, respectively. This rectangular base in the form of a frame slides on the inside surface of the back 34 of the case. It has a generally elliptical boss projecting forward, the boss being shown at 81B (FIGS. 5, 6, 10 and 13). It projects through a slot 61H in the slide 61. At the lower end of the lever lock, there is a detent lug 81P which is normally received in a detent socket 61K of the slide. Therefore, this detent normally keeps the boss 81B near the lower end of the slot 61 in the slide. But when the lever is open as shown in FIG. 10, the lever lock slide 81 can be moved upward as the cam portion 66C of the lever base has been moved up to the point where the ledge 66L is out of the way of the upper end 81E of the lever lock slide. When this lever lock slide is up in the position shown in FIG. 10, the detent lug 81P has moved into the upper detent socket 61R to retain the slide 81 in position where the upper end 81E is engaged with the cylindrical portion of the lever and the front face of the slide at that location is abuttingly engaged by the ledge 66L of the cam portion of the lever base. In this condition, the lever cannot now be rotated around the axis 67. Therefore, pushing arm 66A downward, will push the slide downward. Then, to release the lever for closure after the bolt is in the socket 24 of the threshold, it is only necessary to then push the lever lock 81 downward, returning the detent lug 81P into the detent socket 61K. This moves the upper end 81E of the lever lock slide out of the way of the ledge 66L of the lever base, whereupon the lever can be returned downward to the closed condition.

To secure the lever in closed position, a detent post 66P is provided on the back side of the lever near the distal end and projects into a detent receiver hole 81H in the boss 81B of the lever lock slide. The lever lock slide has a cylindrical rib in hole 81H receiving the head 66H of the post 66P whereby the lever can be snapped closed. This detent arrangement also enables pulling the lever open in the direction of the arrow 73 without undue effort, as the resiliency of the plastic head on the post and the wall of the receiver hole 81H enables this to happen. At the same time, however, upon closure of the lever, it will snap closed. Similarly, because the portion 81S of the lever lock slide 81 is an arm 81A cantilever mounted to slide 81 and with a lug 81P at the distal end, there is a spring action with an audible snap sound as the lever lock is moved up or down into one or the other of the two detent sockets 61K and 61R in the slide 61. Similarly, when the lever is closed from the position shown in FIG. 10 to that in FIG. 5, as the head 66H of post 66P of the lever arm 66A enters the detent rib 81G of the receiver hole 81H, there is an audible snap, providing not only the tactile response, but also an audible click response to closure and secure closure of the lever with the lever lock 81.

It can be recognized from the foregoing, that in order to close the active door 16 with the passive door 17, the lever must be closed. While it may be noted from the above description that the lever 66 can be closed in either the unlocked or locked position of the slide, a significant advantage is derived from this arrangement in the bolt locked position. This is due to the fact that, when the active door is closed, the gap between the facing edges of the active door and the passive door is so small as to prevent opening of the lever. In this condition, the projection of the lever base ledge 66L into the slot 72 prevents movement of the slide, and thereby the bolt, upward at all. While it is possible for a burglar of some skill, to compromise the conventional slide bolt of typical prior art construction found in such doors, it is not possible for that to be done with the slide bolt installation according to this embodiment of the present invention whenever the active door is closed, blocking the opening of the lever arm 66.

Having described the lock assembly installation according to one embodiment of the present invention and the feature of the invention incorporating it into an astragal, further inventive adaptation of the lock assembly to other sites will be described now.

Figure 14:
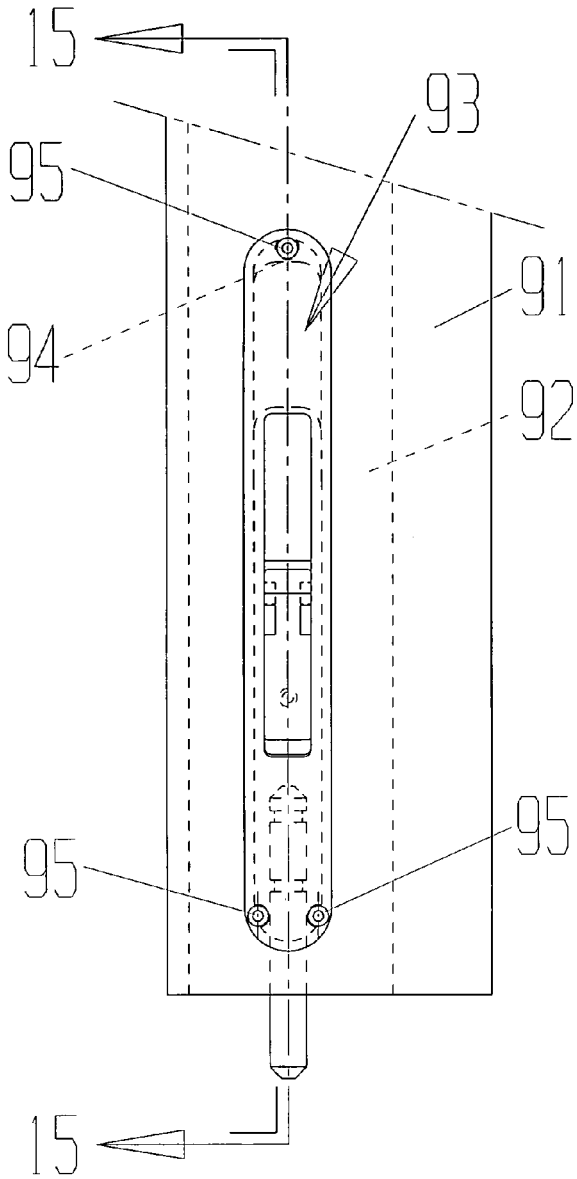
FIG. 14 is an elevational view similar to FIG. 3 but showing an embodiment of the invention including a round ended case in a milled slot in a wood astragal at the edge of a door (shown fragmentarily).
Figure 15:
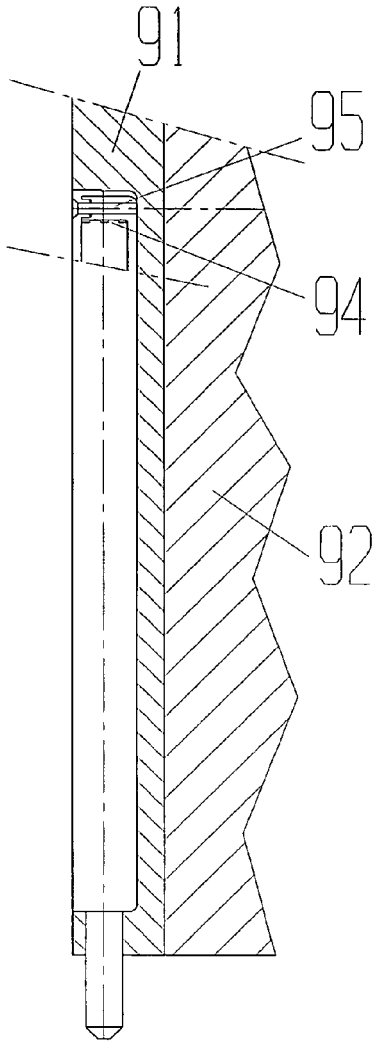
FIG. 15 is a schematic view of the lock assembly in the slot at the astragal section line 15—15 in FIG. 14 and viewed in the direction of the arrows.
Figure 21:
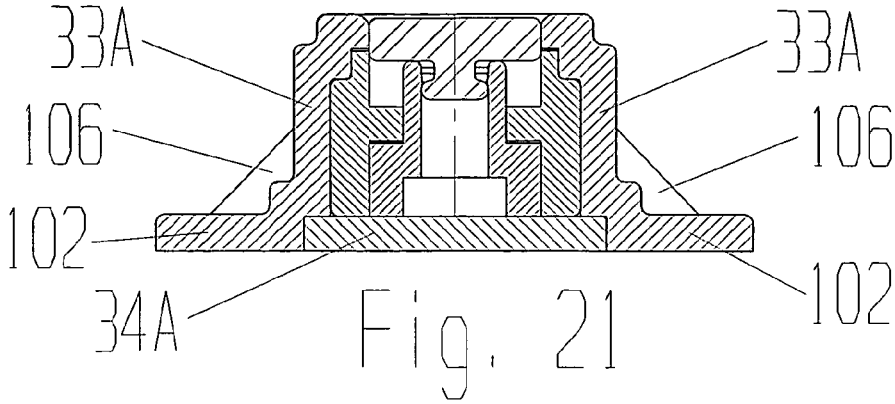
FIG. 21 is an enlarged cross section taken at line 21—21 in FIG. 20.
Figure 19:
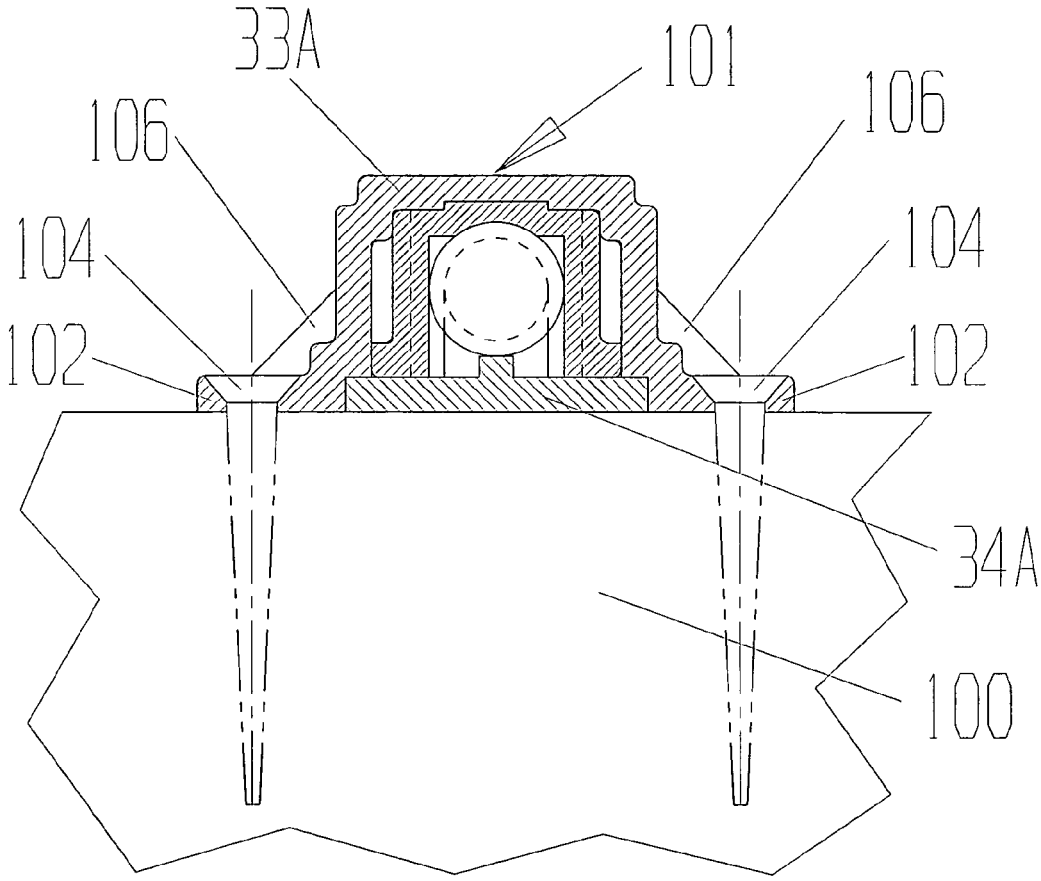
FIG. 19 is an enlarged fragmentary sectional view through the lock assembly at line 17—17 in FIG. 16.
Figures 20, 22, 23:
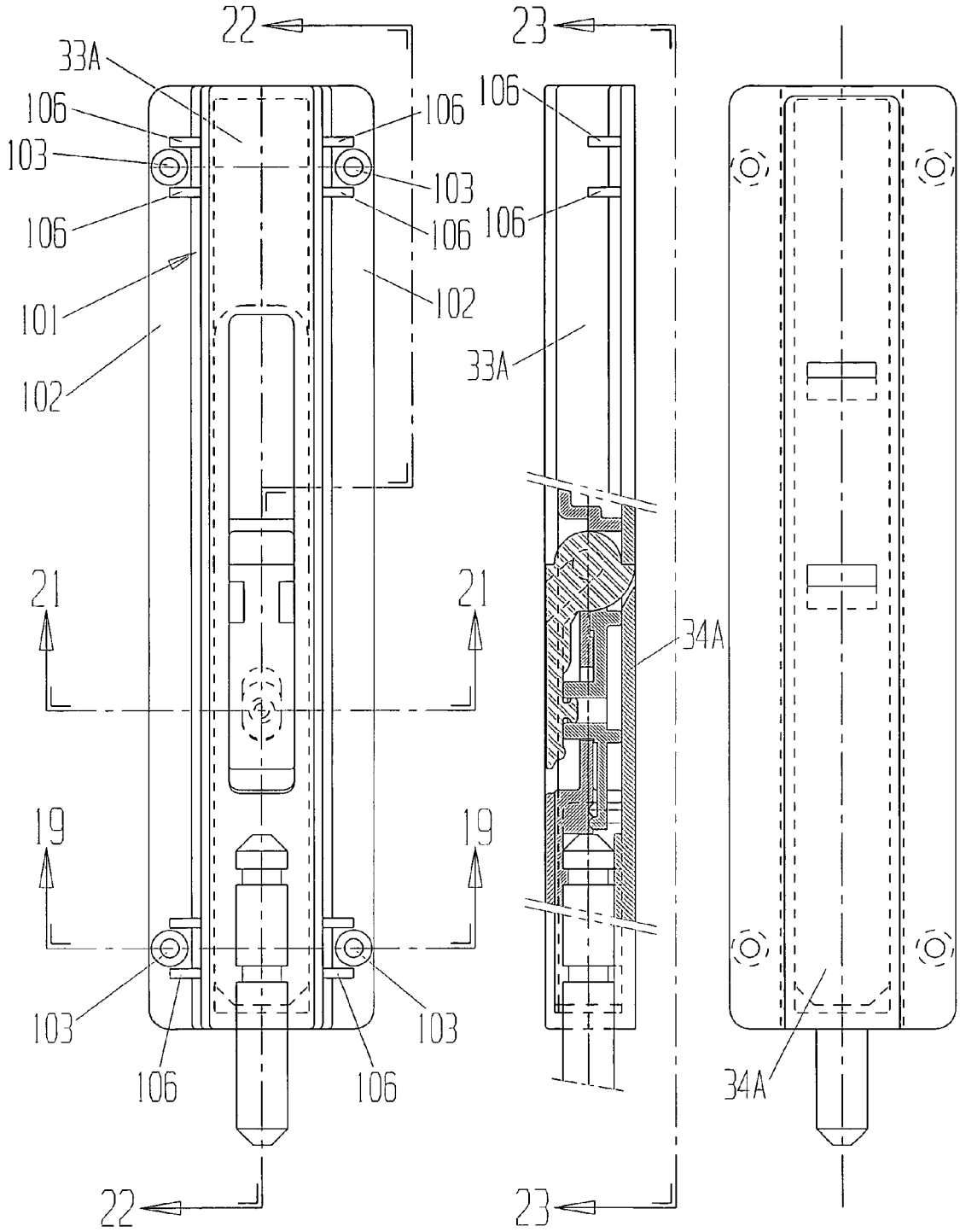
FIG. 20 is an enlarged front view similar to FIG. 5 but showing the surface mounting embodiment.
FIG. 22 is a longitudinal section taken at line 22—22 in FIG. 20 and viewed in the direction of the arrows.
FIG. 23 is a back view of the FIG. 20 embodiment.

Referring to FIGS. 14 and 15, a lock assembly incorporating features described above is shown. FIG. 14 is a view looking at a wood astragal 91 affixed on the edge of a passive door 92 made of wood. A cavity has been milled in the astragal and receives the lock assembly 93. The case 94 is similar to case 31 of the previously described embodiment, except for some external features, most notably the rounded upper and lower ends and the fact that holes are provided in the bottom and top for screws or nails at 95 to secure the case in the astragal. In this instance, the bolt 22 is shown in the extended position. Internal operating components are the same as in the previously described embodiment. The front of the case is flush with the face of the astragal. Of course, the embodiment of FIGS. 14 and 15 can be used directly in the edge of a door without an astragal.

Referring now to FIGS. 16–28, a surface mounted embodiment of the invention is disclosed and which enables a variety of applications. FIGS. 16 and 17 are similar to FIGS. 1 and 2 but show a lock assembly mounting to the face of a passive door without an astragal, although of course it can be used with doors having an astragal. In this surface mounted lock assembly, the internal components of the lock assembly are essentially the same as for the previously described embodiments. But the exterior of the case is somewhat different, comprising a main body 33A and bottom cover plate 34A. More specifically, case 101 has mounting flanges 102 on both sides of the main body 33A, each flange having two holes 103 receiving screws 104 screwed into the door 100. Bracing ribs 106 are provided at each of the screw holes. This case can be mounted on the face of a door, typically at the top and bottom as shown in FIG. 16. The bolt receiver sockets may be in the header and threshold, although, as shown in FIG. 18, not directly under the door, in contrast to the previously described embodiments. Alternatively, bolt receiver brackets such as 109 in FIG. 24 can be surface mounted to the face of a sill plate, foot plate, door frame or header as in FIGS. 24–28, if more convenient for the particular installation site.

Figure 24:
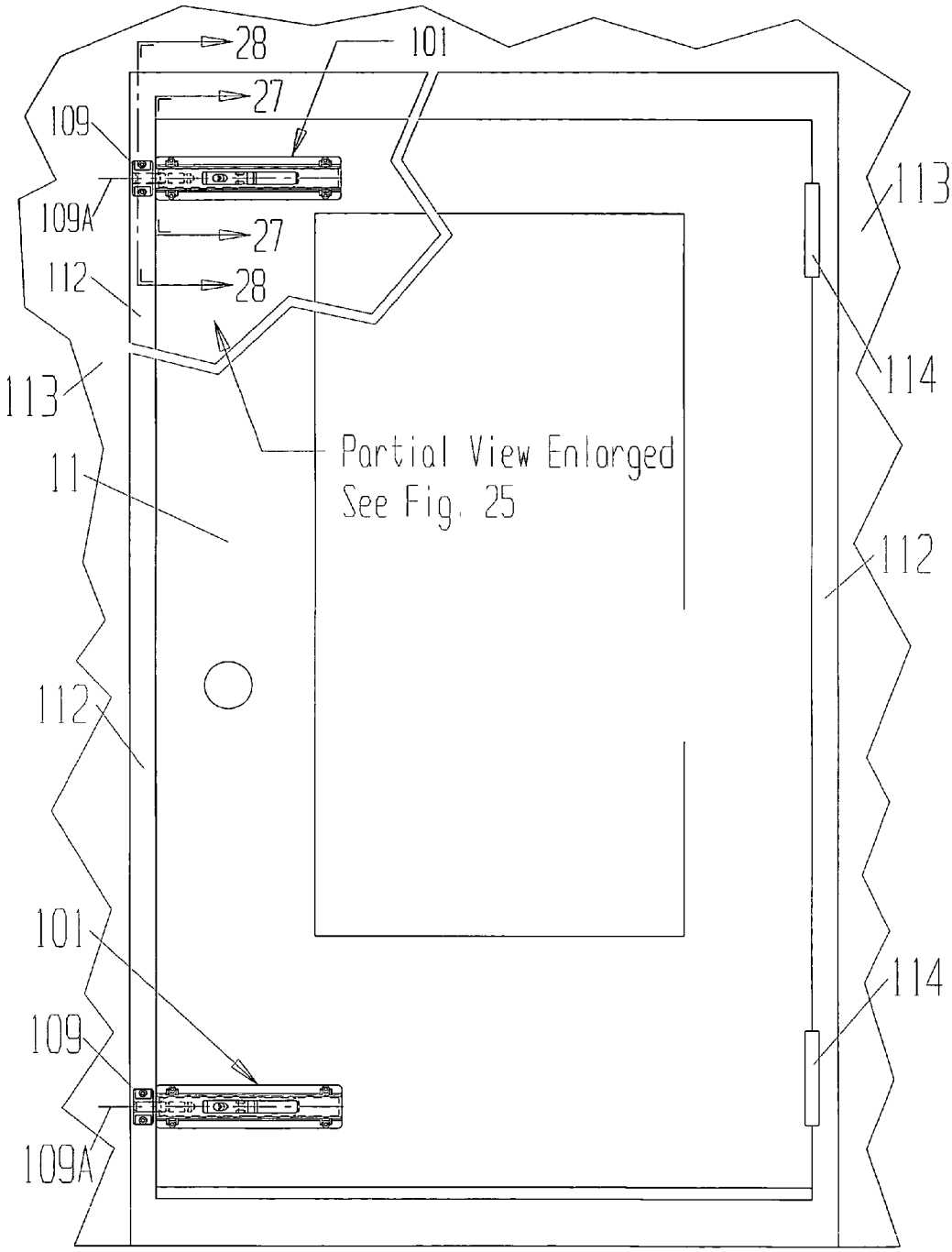
FIG. 24 is an elevational view of a doorway with a single swinging door and a surface-mounted slide bolt locking system according to a further embodiment of the present invention.
Figure 25:
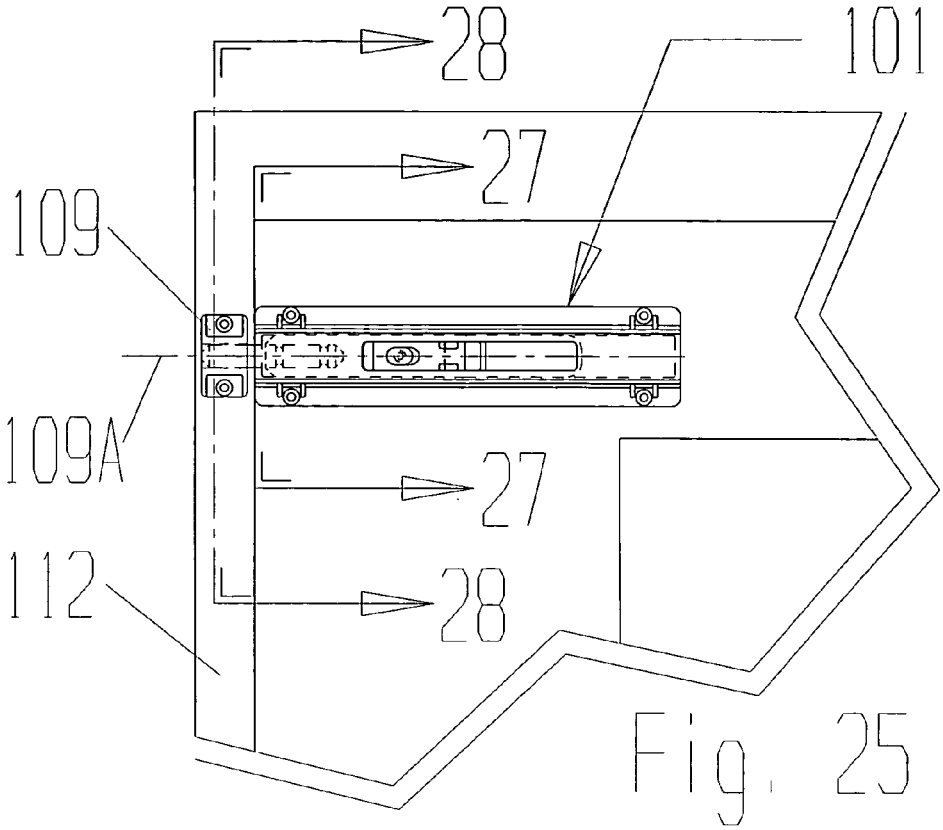
FIG. 25 is an enlarged fragmentary view of a portion of FIG. 24.
Figure 26:
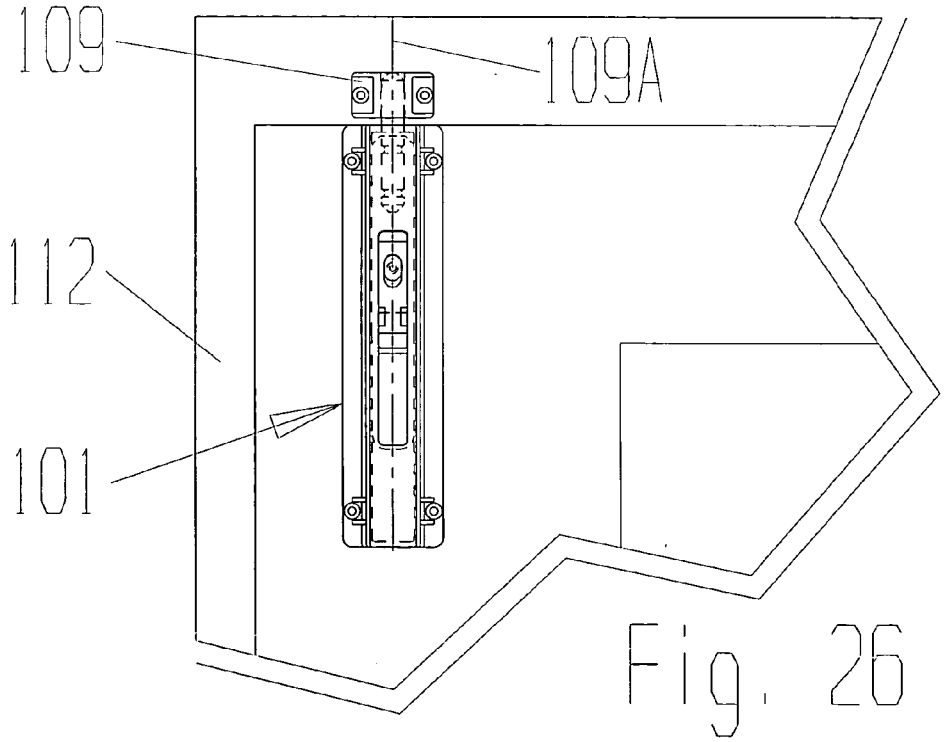
FIG. 26 is an enlarged view showing a surface-mounted slide bolt with vertical axis.
Figure 27:
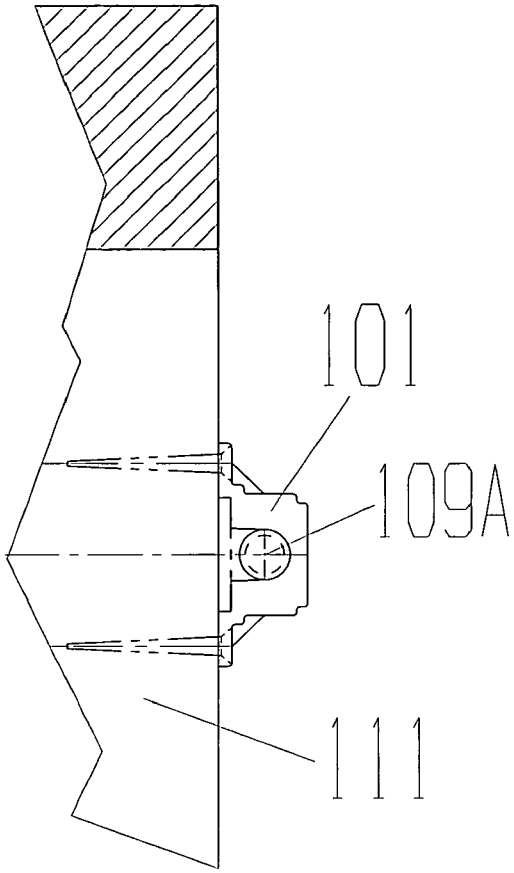
FIG. 27 is a view of the edge of the door at line 27—27 in FIG. 25 and viewed in the direction of the arrows.
Figure 28:
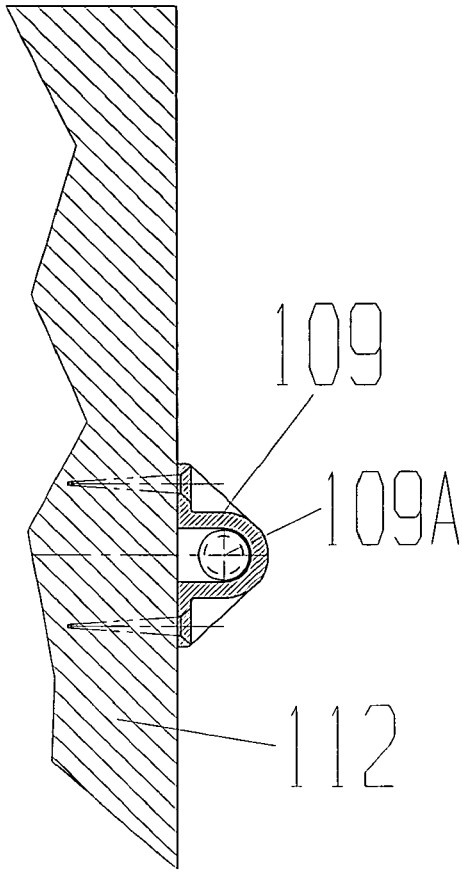
FIG. 28 is a section at line 28—28 in FIG. 25 and viewed in the direction of the arrows.

Referring now to FIGS. 24 and 25, a door 111 is received in an opening in a wall 113. It is mounted to the door frame 112 by hinges 114. Two surface-mounted lock assemblies are provided adjacent the swinging edge of the door at 101. Alternately or additionally, a surface mounted lock assembly can be mounted near the top of the door as shown in FIG. 26. In any event, the bolts are mounted for cooperation with a bolt receiver bracket 109 mounted to a surface on the door frame 112 which is co-planar with the surface of the door 111. In some instances, the surface of the door and the basic wall at the door frame and header might not be co-planar. In those instances, shims may be provided under the bolt assembly case or under the bracket, as the situation may require, for proper alignment of the bolt axis with the receiver axis 109A.

All of the embodiments of the invention can be used with windows as well as doors. Use with hinged or sliding windows and with sliding doors can be accomplished too. Where the bolt assembly is mounted with the bolt axis horizontal, as in the example of FIGS. 24 and 25, particularly if smaller doors such as Dutch door, or pantry doors, or cabinet doors are used, it might not be necessary to provide the lever lock feature to force the lever to stay open for sliding the bolt into locking position, so the lever lock slide may be omitted, if desired.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected by the following claims. In such claims, the term "partition" should be understood to include and not is not limited to a door or window or gate, and capable of partially or fully closing an opening, and the lock case could be on a movable or stationary component at a site.

What is claimed is:

1. A slide lock comprising:

an elongate case;

a slide mounted to said case, said slide having a longitudinal axis and mounted to said case for sliding relative to said case and in the direction of said axis, between a first position and an second position, said slide having a recess;

a lever having an arm and a base and mounted on said slide, said lever being operable between a first condition with said arm received in said recess in said slide, and a second condition with said arm projecting in a direction transverse to the axis of said slide;

said case having first and second slide blocker detents at locations spaced along a line parallel to said axis;

said lever base having a portion receivable in said first detent when said slide is in said first position with said lever in said first condition, and said portion being received in said second detent when said slide is in said second position and said lever is in said first condition, to inhibit said slide from sliding relative to said case when said lever is in said first condition;

a lever lock mounted in said slide, said lever lock being engageable with said lever and operable, when actuated, to prevent said lever from returning from said second condition to said first condition;

said lever lock is mounted in said slide and is slidable relative to said slide between a disabled condition and an enabled condition; and said lever lock is slidable, upon actuation, from said disabled condition to said enabled condition when said lever is in said second condition, to lock said lever in said second condition.

2. The slide lock of claim 1 and further comprising:

a first lever retainer detent located on said lever arm;

a second lever retainer detent located on said lever lock;

said lever retainer detents being cooperable when said lever lock is disabled, to retain said lever in said first condition.

3. The slide lock of claim 2 and further comprising:

a first lever lock retainer detent located on said lever lock;

a second lever lock retainer detent located on said slide;

said first and second lever lock retainer detents being co-operable when said lever lock is in said enabled condition to retain said lever lock in said enabled condition.

4. The slide lock of claim 3 and further comprising:

a third lever lock retainer detent located on said slide, said first lever lock retainer detent and said third lever lock retainer detent being co-operable when said lever lock is in said disabled condition, to retain said lever lock in said disabled condition.

5. The slide lock of claim 3 and wherein:

said lever lock has a cantilever arm with a proximal end and a distal end; and said first lever lock retainer detent is on said cantilever arm at a location remote from said proximal end.

6. The slide lock of claim 5 and wherein:

said third lever lock retainer detent has a portion in the path of said first lever lock retainer detent as said lever lock is slid from said disabled condition to said enabled condition, whereby said cantilever arm is resiliently deformed by said first lever lock retainer detent engaging said third lever lock retainer detent during passage of said lever lock from said disabled condition to said enabled condition.

7. A locking system in a structure having a wall defining an exterior and an interior of the structure, the structure having an opening therein for passage between the said exterior and interior, and the structure having a partition mounted to the structure and movable relative to the wall to selectively open and close at least part of said opening, the structure having a stationary lock base at said opening and a lock base on said partition, the system comprising:

an elongate case mounted on said one of said lock bases;

a slide mounted to said case, said slide having a longitudinal axis and mounted to said case for sliding relative to said case and in the direction of said axis, between a first position and a second position, said slide having a recess;

a lock bolt on said slide and engageable with the other of said lock bases when said partition is moved to a position closing at least part of said opening;

a lever having an arm and having a hub and pivotally mounted on said slide, said lever being pivotally operable between a first condition with said arm received in said recess in said slide, and a second condition with said arm projecting in a direction transverse to the axis of said slide, to enable use of said arm to slide said lock bolt into engagement with the other of said lock bases to lock said partition in said position closing at least part of said opening;

said partition has a front face, a back face and an astragal forming an edge; and said case is located in said astragal;

said astragal has a groove therein;

said case is retained in said groove; and said case is retained in said groove by friction fit in said groove.

8. The locking system of claim 7 and wherein:

said partition has a top and a bottom;

said astragal comprises a metal extrusion; and said case has guide pads engaging said groove in said astragal, at least one of said pads being interference fitted in said groove to retain said case in said groove.

9. The locking system of claim 8 and wherein:

said astragal extends between the top and bottom of said partition; and said case is located adjacent the bottom of said partition;

the system further comprising:

a second elongate case mounted in said groove in said astragal adjacent the top of said partition;

a second slide having a longitudinal axis and mounted to said second case for sliding relative to said second case, between a first position and a second position of said second slide, said second slide having a recess;

a second lock bolt on said second slide and engageable with a second stationary lock base when said partition is moved to said position closing at least part of said opening;

a second lever having a second arm and having a hub and mounted on said second slide, said second lever being operable between a first condition with said second arm received in said recess in said second slide, and a second condition with said second arm projecting in a direction transverse to the axis of said second slide, to enable use of said second arm to slide said second lock bolt into engagement with said second stationary lock base lock said partition in said position closing at least part of said opening.

* * * * *